US008560170B2

(12) United States Patent
Hoshi et al.

(10) Patent No.: US 8,560,170 B2
(45) Date of Patent: Oct. 15, 2013

(54) METHOD FOR ESTIMATING AMOUNT OF HEAT RECEIVED BY REFRIGERANT AND CONTROLLER

(75) Inventors: Koichi Hoshi, Susono (JP); Yoshihisa Shinoda, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 138 days.

(21) Appl. No.: 13/126,943

(22) PCT Filed: Jan. 30, 2009

(86) PCT No.: PCT/JP2009/051602

§ 371 (c)(1),
(2), (4) Date: Apr. 29, 2011

(87) PCT Pub. No.: WO2010/086999

PCT Pub. Date: Aug. 5, 2010

(65) Prior Publication Data

US 2011/0282547 A1 Nov. 17, 2011

(51) Int. Cl.

| | |
|---|---|
| ***G06F 7/00*** | (2006.01) |
| *G06F 19/00* | (2011.01) |
| *G06G 7/70* | (2006.01) |

(52) U.S. Cl.
USPC ..... 701/36; 701/99; 701/101; 701/102

(58) Field of Classification Search
USPC ..... 701/36, 99, 101, 102
See application file for complete search history.

(56) References Cited

U.S. PATENT DOCUMENTS

| | | | | |
|---|---|---|---|---|
| 4,285,246 | A * | 8/1981 | Kita | 73/861.03 |
| 5,117,646 | A * | 6/1992 | Nose et al. | 62/181 |
| 6,230,505 | B1 * | 5/2001 | Noda et al. | 62/159 |
| 6,857,398 | B2 * | 2/2005 | Takagi et al. | 123/41.1 |
| 8,171,895 | B2 * | 5/2012 | Scolton et al. | 123/41.09 |

FOREIGN PATENT DOCUMENTS

| | | |
|---|---|---|
| JP | A-63-208607 | 8/1988 |
| JP | A-03-179122 | 8/1991 |
| JP | A-2003-227337 | 8/2003 |
| JP | A-2005-188352 | 7/2005 |
| JP | A-2009-2166 | 1/2009 |

OTHER PUBLICATIONS

International Search Report in International Application No. PCT/JP2009/051602 dated Jun. 9, 2009 (with English-language translation).

* cited by examiner

*Primary Examiner* — Khoi Tran
*Assistant Examiner* — Nicholas Kiswanto
(74) *Attorney, Agent, or Firm* — Oliff & Berridge, PLC

(57) ABSTRACT

A method for estimating the amount of heat received by refrigerant by an ECU comprises a step for detecting an estimation factor including the intake air amount of an internal combustion engine, and a step for estimating the amount of heat received from exhaust gas by cooling water of the internal combustion engine in a water-cooled exhaust manifold based on a detected estimation factor. Preferably, the estimation factor further includes at least any one of the cooling water temperature, the intake air temperature of the internal combustion engine, or the number of revolutions of the internal combustion engine.

7 Claims, 10 Drawing Sheets

METHOD FOR ESTIMATING AMOUNT OF HEAT RECEIVED BY REFRIGERANT AND CONTROLLER

TECHNICAL FIELD

The present invention relates to a method for estimating the amount of heat received by a refrigerant and a control device, and more particularly, to a method for estimating the amount of heat received by a refrigerant in an exhaust-system cooling means for cooling an exhaust system of an internal combustion engine and a control device that performs a control on the basis of the amount of heat estimated by the estimation method.

BACKGROUND ART

Conventionally, there is known an art of cooling an exhaust system of an internal combustion engine (more particularly, an exhaust manifold, for example) by a refrigerant such as water. As to such an art, an art that may be relative to the present invention is disclosed in Patent Document 1. In Patent Document 1, there is disclosed an exhaust manifold apparatus equipped with a water jacket formed around an exhaust manifold and a water injection means that injects water to the water jacket in the form of spray.

Patent Document 1: Japanese Patent Application Publication No. 63-208607

DISCLOSURE OF THE INVENTION

Problems to be Solved by the Invention

Now, as an approach to environment problems, the internal combustion engine is required to reduce exhaust emissions. In this regard, in reduction of exhaust emissions under light and middle load engine operating conditions, there is a method for arranging a three-way catalyst in proximity to the internal combustion engine and warming up the three-way catalyst promptly.

In order to reduce exhaust emissions under heavy load operating conditions by using the above method, it is desired to operate the internal combustion engine at the stoichiometric air-fuel ratio or a ratio close thereto. However, in this case, the catalyst may overheat due to the close arrangement of the catalyst to the internal combustion engine, and excessive progress of deterioration of the catalyst and deterioration of exhaust emissions due to the excessive progress of deterioration are of concern. Thus, when it is considered to reduce the exhaust emissions under the heavy load operating conditions, the three-way catalyst should be arranged away from the internal combustion engine. However, this arrangement may not realize sufficient reduction of exhaust emissions under the light and middle load operating conditions. Thus, it is necessary to employ a larger amount of noble metal that facilitates purification of the catalyst. However, noble metal is rare, and an increase in the cost is of concern.

Under the above-described circumstances, in order to achieve a balance in further reduction of exhaust emissions between the light or middle load engine operation and the heavy load engine operation, it has been studied to cool the exhaust system by a refrigerant and decrease the exhaust gas temperature. This may suppress overheating of the catalyst. It is thus possible to arrange the catalyst close to the internal combustion engine and to suitably achieve a balance in further reduction of exhaust emissions between the light or middle load operating conditions and the heavy load operating conditions.

However, in the case of cooling the exhaust system by the refrigerant, the temperature of the refrigerant rises in accordance with the amount of heat received from the exhaust system. In this regard, more specifically, in a case where cooling water is used as the refrigerant for the internal combustion engine, the exhaust system is added to objects that should be cooled by the cooling water. Thus, the amount of heat received by the cooling water increases, and the cooling capability may be degraded accordingly. Further, as has been described above, in the case where the internal combustion engine is operated at the stoichiometric air-fuel ratio or a ratio close thereto under the heavy load operating conditions, the amount of heat received by the cooling water increases greatly. Thus, there is a possibility that the cooling capability of the cooling water may be degraded considerably. In this case, there is a possibility that the exhaust system may not be cooled properly and further the internal combustion engine may not be cooled properly. Thus, the internal combustion engine may overheat.

In this regard, if it is possible to figure out the environmental conditions under which the exhaust system that is one of the objects to be cooled by the refrigerant is used, it is possible to take various measures for coping with situations in which the cooling capability of the refrigerant deteriorates. For example, the use of a sensor such as an exhaust gas temperature sensor may be considered in order to figure out the environmental conditions under which the exhaust system is used. However, the use of the sensor such as the exhaust gas temperature sensor increases the cost of cooling the exhaust system by the refrigerant. Although the exhaust gas temperature sensor is generally less expensive, the cost will increase considerably as a whole if the above cooling system is thoroughly expanded to other internal combustion engines.

The exhaust system of the internal combustion engine is under inferior conditions such as high temperature and high humidity for electronic components. Thus, the use of the exhaust gas temperature sensor is not preferable in terms of reliability. In this regard, in the United States, it is required to meet the OBD regulations that prescribe obligations to cope with a failure of sensors or an out-of-range thereof. More specifically, for example, it is necessary for one exhaust gas temperature sensor to monitor another exhaust gas temperature sensor in order to detect a failure of the sensors. In this case, it is possible to detect a failure of the sensor or the out-of-range thereof and to ensure the reliability even when the exhaust gas temperature sensor is used. However, this case uses two exhaust sensors or more and causes a further increase in the costs of production.

The present invention was made in view of the above problems and aims to provide a method for estimating, at low costs, the amount of heat received by a refrigerant capable of figuring out the environmental conditions under which the exhaust system that is an object to be cooled by the refrigerant by estimating the amount of heat received by the refrigerant in exhaust system cooling means, and to provide a control device capable of suitably coping with a situation in which the cooling capability of the refrigerant deteriorates by performing a control based on the amount of heat estimated by the method for estimating the amount of heat received by the refrigerant.

Means for Solving the Problems

A method for estimating an amount of heat received by a refrigerant directed to solving the above problems includes the steps of: detecting estimation factors including an intake air amount of an internal combustion engine; and estimating, on the basis of the estimation factors detected, the amount of heat which the refrigerant receives from the exhaust by an exhaust system cooling means that cools an exhaust system of the internal combustion engine by the refrigerant.

The method for estimating an amount of heat received by a refrigerant of the present invention is preferably configured so that the estimation factors further include at least one of a refrigerant temperature, an intake air temperature of the internal combustion engine and a number of revolutions thereof.

The method for estimating an amount of heat received by a refrigerant of the present invention is preferably configured so that the refrigerant is a cooling water of the internal combustion engine.

A control device of the present invention is equipped with detecting means for detecting estimation factors including an intake air amount of an internal combustion engine; estimating means for estimating, on the basis of the estimation factors, an amount of heat which a refrigerant receives from an exhaust by an exhaust system cooling means that cools an exhaust system of the internal combustion engine by the refrigerant; and control means for performing at least one of a control to reduce an amount of heat generated in the internal combustion engine, a control to increase the amount of heat generated in the internal combustion engine, and a control to facilitate radiation of heat from the refrigerant, when the amount of heat estimated by the estimating means is equal to or larger than a predetermined value.

The control device of the present invention is preferably configured so that the estimation factors further include a refrigerant temperature, an intake air temperature of the internal combustion engine and a number of revolutions thereof.

The control device of the present invention is preferably configured so that the control to reduce the amount of heat generated in the internal combustion engine decreases an amount of fuel injected in the internal combustion engine so that an air-fuel ratio is set higher than a stoichiometric air-fuel ratio.

The control device of the present invention is preferably configured so that the refrigerant is water of the internal combustion engine.

Effects of the Invention

According to the present invention, it is possible to figure out, at low costs, the environmental conditions under which the exhaust system that is an object to be cooled by the refrigerant by estimating the amount of heat received by the refrigerant in the exhaust system cooling means. According to the present invention, it is possible to appropriately cope with conditions in which the cooling capability of the refrigerant by performing a control based on the estimated amount of heat.

BEST MODES FOR CARRYING OUT THE INVENTION

Now, a description are given of best modes for carrying out the invention with reference to the drawings.

Figure 1:
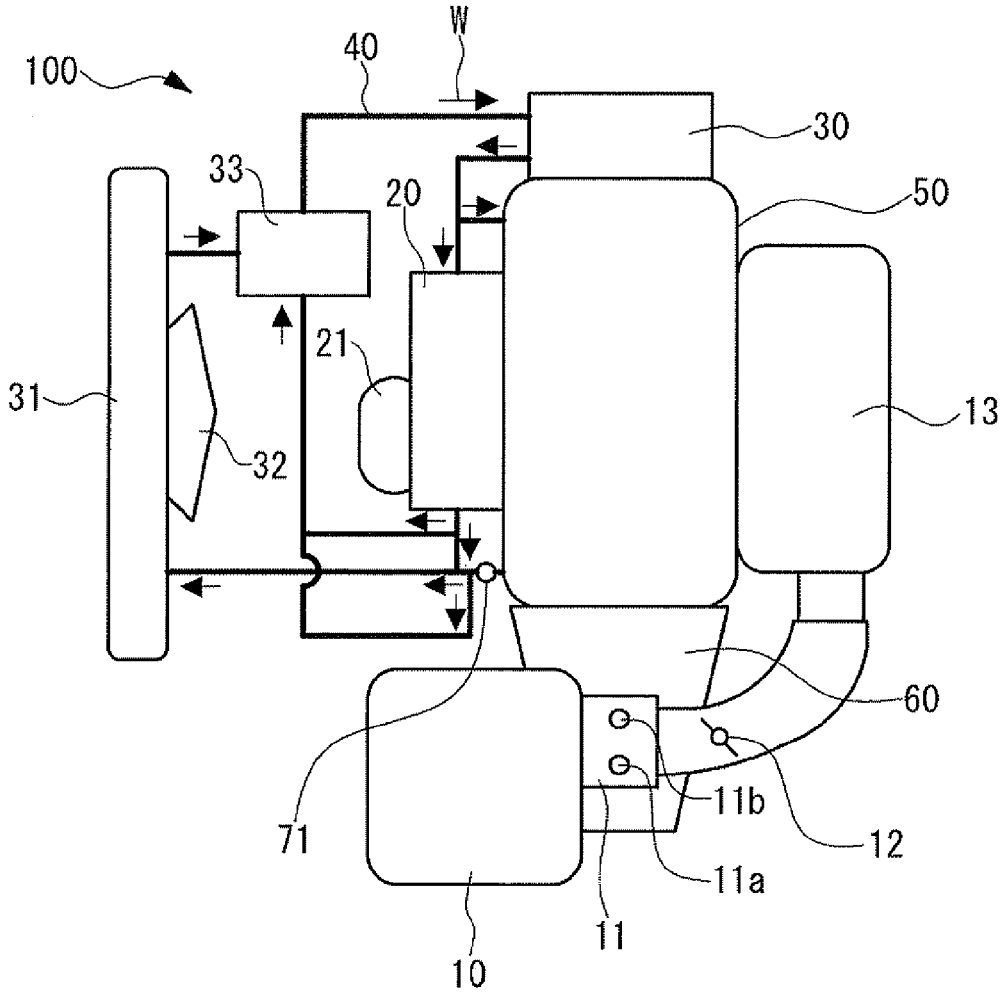
FIG. 1 is a diagram that schematically illustrates an internal combustion engine system 100.

FIG. 1 is a diagram that schematically illustrates an internal combustion engine system 100 to which a control device realized by an ECU (Electronic Control Unit) 1 in accordance with an embodiment. The internal combustion engine system 100 is equipped with an air cleaner 10, an airflow meter 11, an electronic control throttle 12, an intake manifold 13, a water-cooled exhaust manifold 20, a catalyst 21, a mechanical water pump 30, a radiator 31, an electric fan 32, a thermostat 33, cooling water pipes 40, an internal combustion engine 50 and a multistep automatic transmission 60.

The air cleaner 10 filters intake air. The airflow meter 11 is equipped with an intake air amount sensor 11*a*, and an intake air temperature sensor 11*b*. The airflow meter 11 measures the amount of intake air and senses the temperature of intake air. The electronic control throttle 12 adjusts the amount of intake air. The intake manifold distributes the intake air to cylinders of the internal combustion engine 50. In the internal combustion engine 50, a mixture of intake air and fuel is burned. Gas generated by burning is exhausted via the water-cooled exhaust manifold 20 as exhaust gas. The water-cooled exhaust manifold 20 is just followed by the catalyst 21, which cleans up the exhaust gas. The location of the catalyst 21 is close to the internal combustion engine 50.

The internal combustion engine 50 is provided with the mechanical water pump 30. The mechanical water pump 30 is driven by the output of the internal combustion engine 50, and feeds cooling water W with pressure. At this time, some of the cooling water W is fed to a not-illustrated water jacket provided in the internal combustion engine 50, and some of the remaining cooling water W is fed to the water-cooled exhaust manifold 20. Some of the cooling water W that receives heat generated in the internal combustion engine 50 flows into the radiator 31, and some of the remaining cooling water W flows into the thermostat 33. Some of the cooling water W that receives heat in the water-cooled exhaust manifold 20 flows into the radiator 31, and some of the remaining cooling water W flows into the thermostat 33. The cooling water W that flows into the radiator 31 loses heat by natural ventilation or ventilation by the electric fan 32, and flows into the thermostat 33. A temperature sensor 71 is provided to a portion of the pipe that is one of the cooling water pipes 40 connecting the internal combustion engine 50 and the radiator 31 and is close to the internal combustion engine 50.

Figure 2:
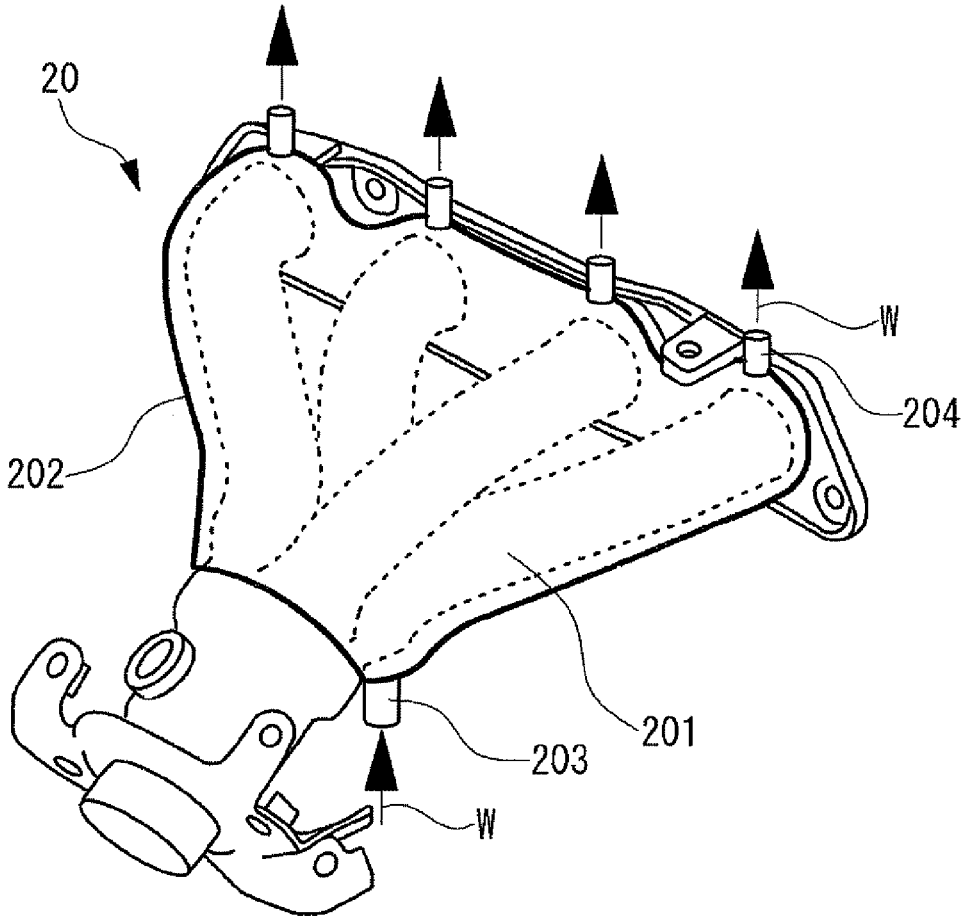
FIG. 2 is a diagram that schematically illustrates a concrete structure of a water-cooled exhaust manifold 20.

FIG. 2 is a schematic view of a concrete structure of the water-cooled exhaust manifold 20. As illustrated in FIG. 2, the water-cooled exhaust manifold 20 is equipped with an outer wall portion 202, which totally encloses exhaust pipes 201. In the water-cooled exhaust manifold 20, the cooling water W is fed to cooling water passages from an cooling water inlet 203, and is discharged from the cooling water passages via cooling water outputs 204. In the present embodiment, the cooling water W of the internal combustion engine 50 is a refrigerant, and the water-cooled exhaust manifold 20 is an exhaust system cooling means.

Figure 3:
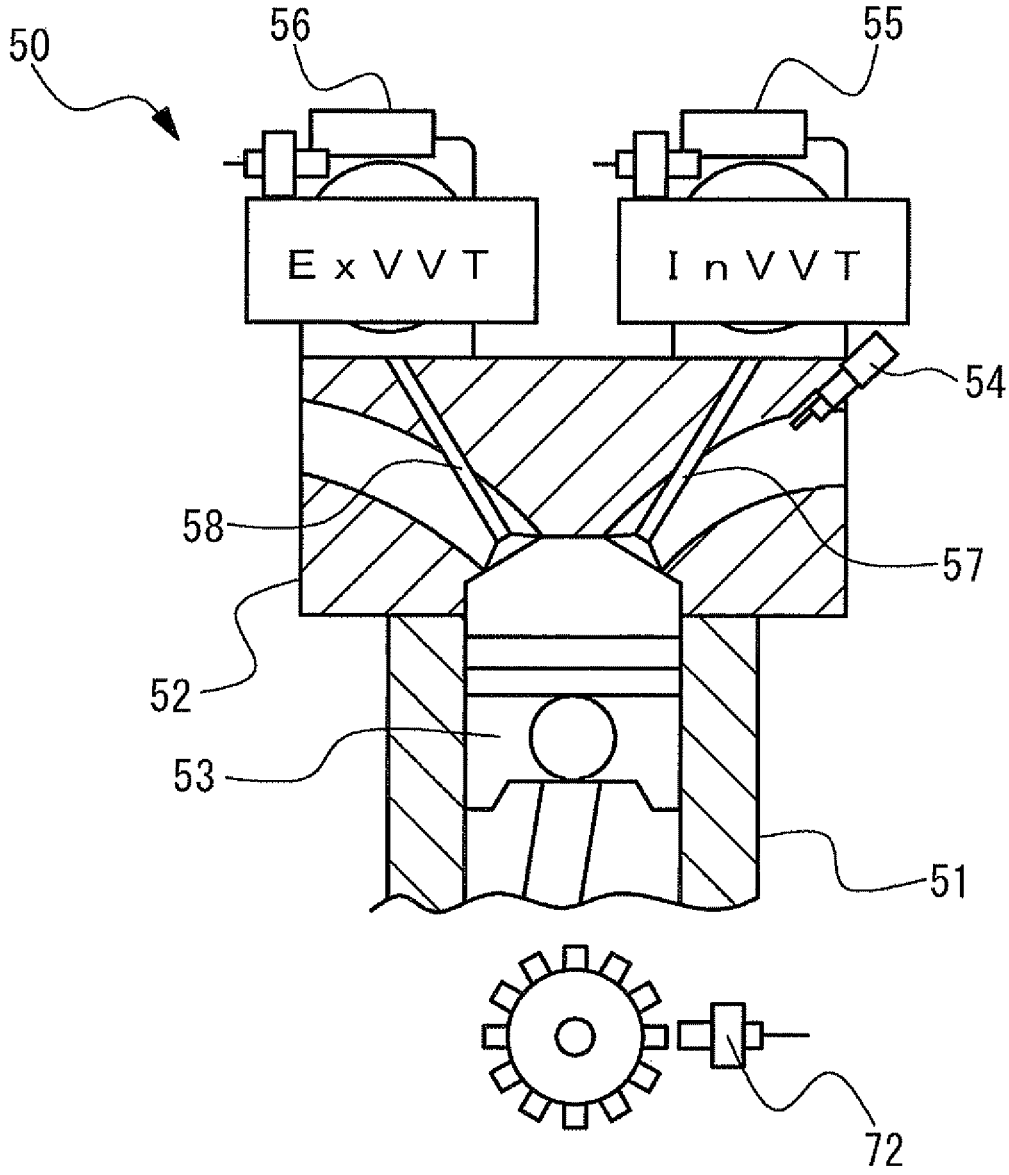
FIG. 3 is a diagram that schematically illustrates one cylinder of an internal combustion engine 50 in the form of a cross section.

FIG. 3 is a diagram that schematically illustrates one cylinder of the internal combustion engine 50 in the form of a cross section. The internal combustion engine 50 is equipped with a cylinder block 51, a cylinder head 52, a piston 53, a fuel injection valve 54, an intake valve 57 and an exhaust valve 58. The amount of fuel injected is adjusted by the valve open period of the fuel injection value 54 under the control of the ECU 1. The internal combustion engine 50 is equipped with an engine speed sensor 72. The fuel injection valve 54 is not limited to the described position but may be arranged so as to enable direct injection of fuel into the cylinder.

The internal combustion engine 50 is equipped with an intake-side VVT 55 and an exhaust-side VVT 56 as variable valve trains. The intake-side VVT 55 is configured to change the working angle (valve open period) of the intake valve 57 and the amount of valve lift thereof. The exhaust-side VVT 56 is configured to change the working angle of the exhaust valve 58 and the amount of valve lift thereof.

Figure 4:
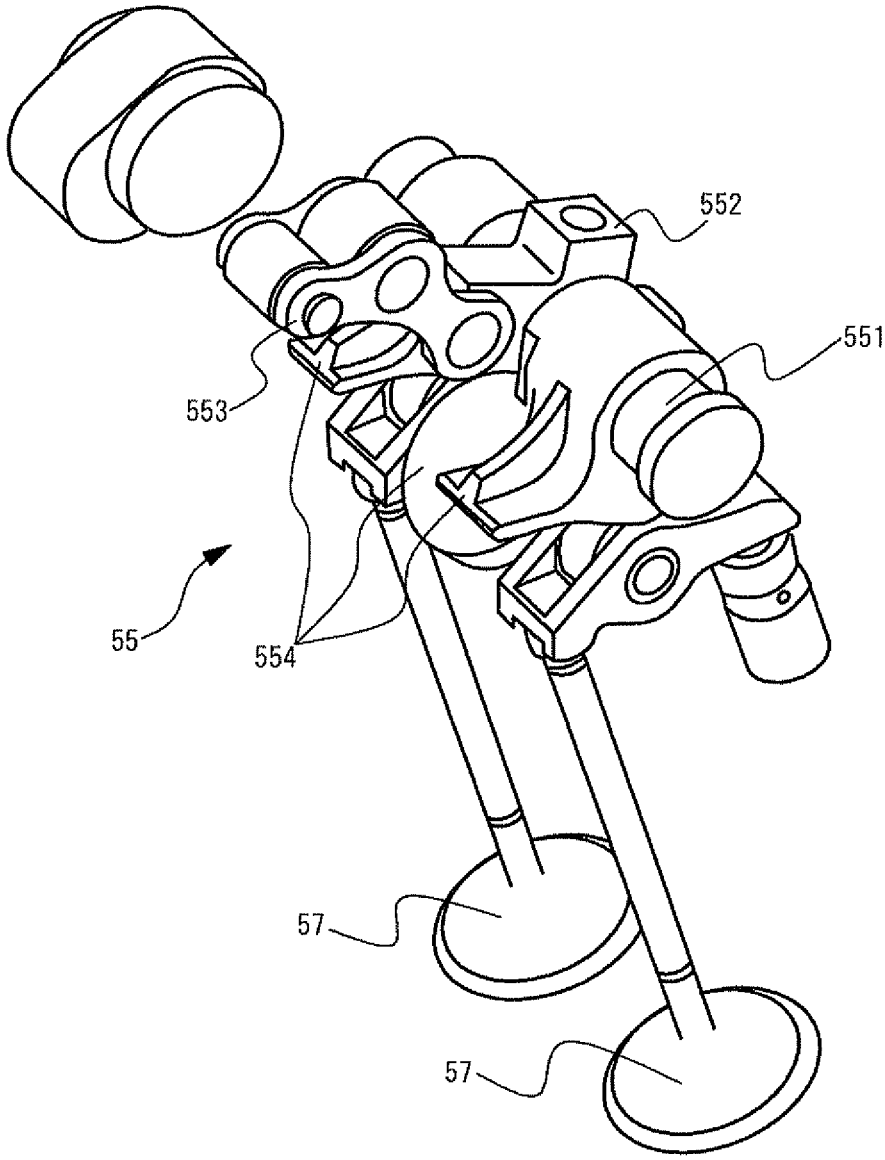
FIG. 4 is a diagram that illustrates a concrete structure of an intake-side VVT 55.

FIG. 4 is a diagram that illustrates a concrete structure of the intake-side VVT 55. The exhaust-side VVT 56 has the same concrete structure as that of the intake-side VVT 55, and an illustration thereof is omitted. The intake-side VVT 55 is equipped with a control shaft 551, a connection arm 552, a slidable contact arm 553, and swing cams 554. In the intake-side VVT 55, the control shaft 551 is appropriately driven under the control of the ECU 1, so that the amount of valve lift and the working angle can be varied continuously.

Figure 5:
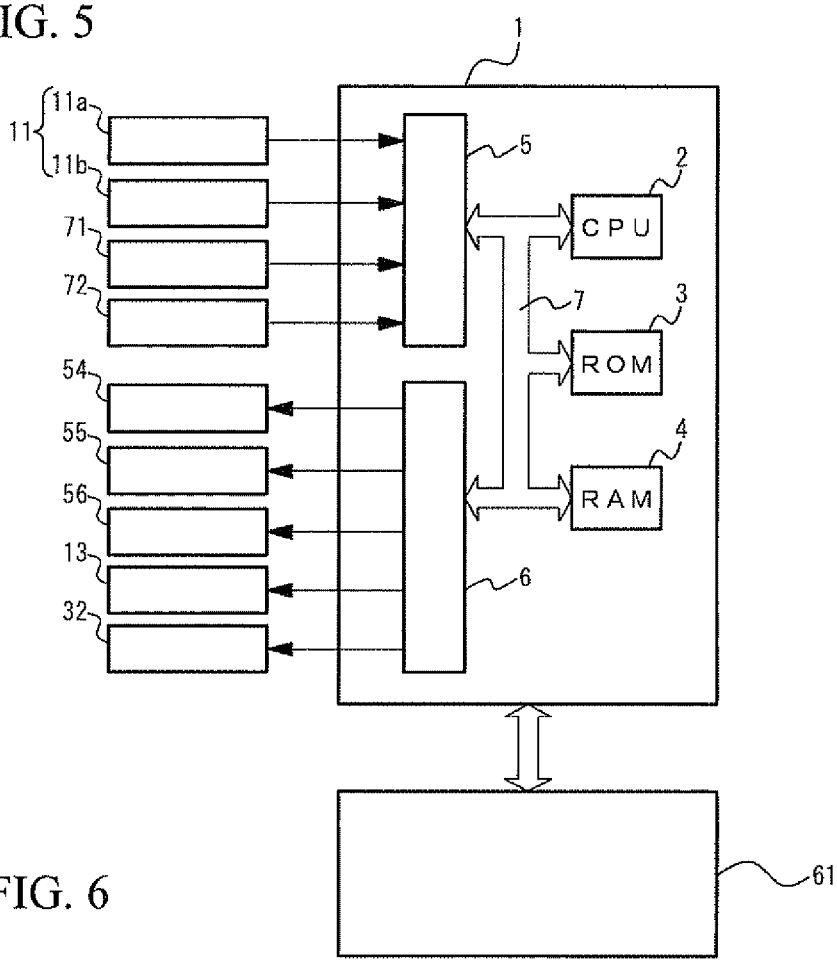
FIG. 5 is a diagram that schematically illustrates a concrete configuration of an ECU 1.

FIG. 5 is a diagram that schematically illustrates a concrete configuration of the ECU 1. The ECU 1 is equipped with a microcomputer composed of a CPU 2, a ROM 3, a RAM 4 and so on, and input/output circuits 5 and 6. A bus 7 connects the CPU 2, the ROM 3, the RAM 4 and the input/output circuits 5 and 6 together. The ECU 1 is configured to mainly control the engine 50. More particularly, the ECU 1 is configured to control the fuel injection valve 54, the intake-side VVT 55 and the exhaust-side VVT 56. Besides, the ECU 1 is configured to control the electronic control throttle 12 and the electric fan 32. These controlled objects are electrically connected to the ECU 1. Further, the ECU 1 is connected to a transmission ECU 61, which controls the multistep automatic transmission 60 so as to communicate therewith. The ECU 1 is configured to permit or inhibit a control implemented by the transmission ECU 61.

To the ECU 1, electrically connected are various sensors that include the airflow meter 11 (more particularly, the intake air amount sensor 11*a* and the intake air temperature sensor 11*b*), the water temperature sensor 71, and the engine speed sensor 72. The intake air amount GA and the intake air temperature etha are detected on the basis of the output of the airflow meter 11. The temperature ethw of the cooling water is detected on the basis of the output of the water temperature sensor 71, and the number of revolutions NE is detected on the basis of the output of the engine speed sensor 72.

The ROM 3 is configured to store programs in which various processes executed by the CPU 2 are described and map data. The CPU 2 executes the processes on the basis of the programs stored in the ROM 3 while utilizing a temporary storage area in the RAM 4 as necessary. Thus, the ECU 1 functionally realizes various control means, determining means, detecting means and calculating means.

In this regard, the ECU 1 functionally realizes detecting means for detecting multiple estimation factors that include the intake air amount GA of the internal combustion engine 50, and estimating means for estimating the amount of heat received by the refrigerant from the exhaust in the water-cooled exhaust manifold 20 on the basis of the multiple estimation factors detected by the detecting means. In the present embodiment, the ECU 1 realizes the method for estimating heat received by the refrigerant. Further, the ECU 1 functionally realizes control means that perform a predetermined control when an estimated cooling loss Qw is equal to or larger than a predetermined value. The predetermined control will be described in detail later.

Preferably, the above-described multiple estimation factors include at least any one of the cooling water temperature ethw that is the refrigerant temperature, the intake air temperature etha, and the number of revolutions NE of the internal combustion engine 50. This is because the above four factors are greatly influential factors for the cooling loss Qw. This specifically results from experimental results illustrated in FIGS. 6 through 14.

Figure 6:
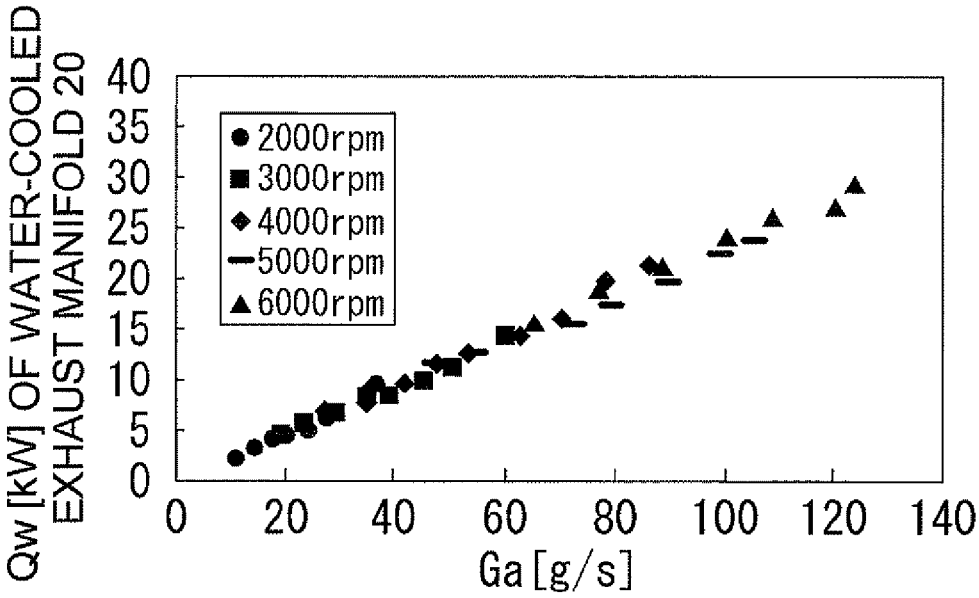
FIG. 6 is a diagram that illustrates a relationship between GA and Qw of the water-cooled exhaust manifold 20.

FIG. 6 is a diagram illustrating a relationship between the intake air amount GA and the cooling loss Qw. FIG. 6 is created from data obtained by a steady operation of the internal combustion engine 50 in the bench test. As illustrated in FIG. 6, the cooling loss Qw increases and decreases so as to be almost proportional to increase and decrease of the intake air amount GA. It can be seen that the intake air amount GA has a strong linear correlation with the cooling loss Qw. Thus, it is adequate to include at least the intake air amount GA in the estimation factors of the cooling loss Qw.

The cooling water temperature ethw and the intake air temperature etha are capable of representing the operating environmental conditions of the internal combustion engine 50 such as the initial condition. Therefore, in cooling the water-cooled exhaust manifold 20 by the cooling water W, it is adequate to additionally consider the cooling water temperature ethw and the intake air temperature etha in order to estimate the cooling loss Qw with higher accuracy.

Figure 7:
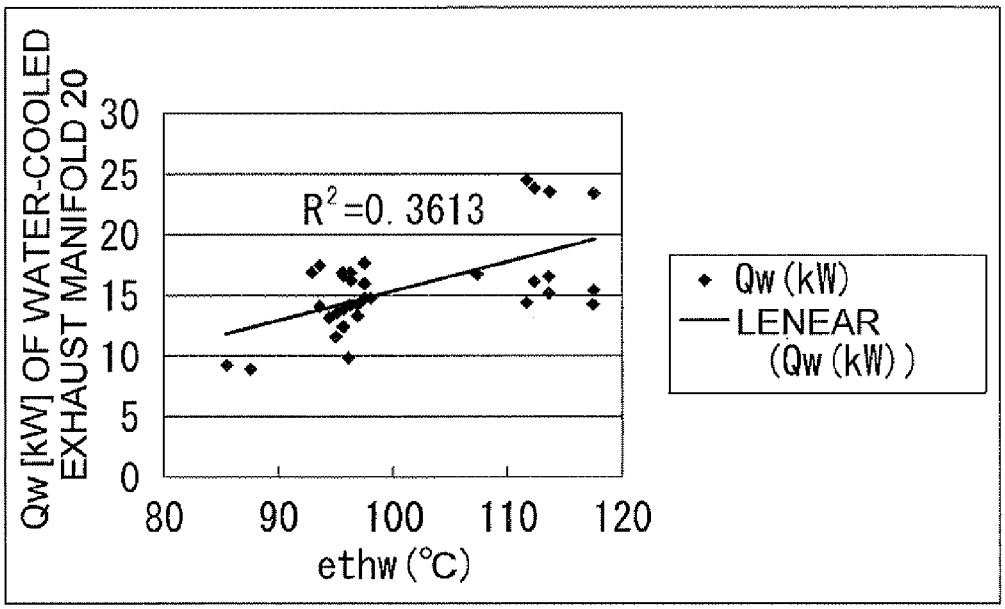
FIG. 7 is a diagram that illustrates a relationship between ethw and Qw of the water-cooled exhaust manifold 20.

However, as illustrated in FIG. 7, in a case where the estimation factor consists of only the cooling water temperature ethw, which is thus used as an indicator of the cooling loss Qw, it is not seen that data have linear gathering. In a case where the data are approximated by the least square method, $R^2$ that indicates the degree of correlation (the degree of correlation is higher as $R^2$ is closer to 1) is 0.3613. That is, this case does not show that the present indicator has a strong linear correlation with the cooling loss Qw.

Figure 8:
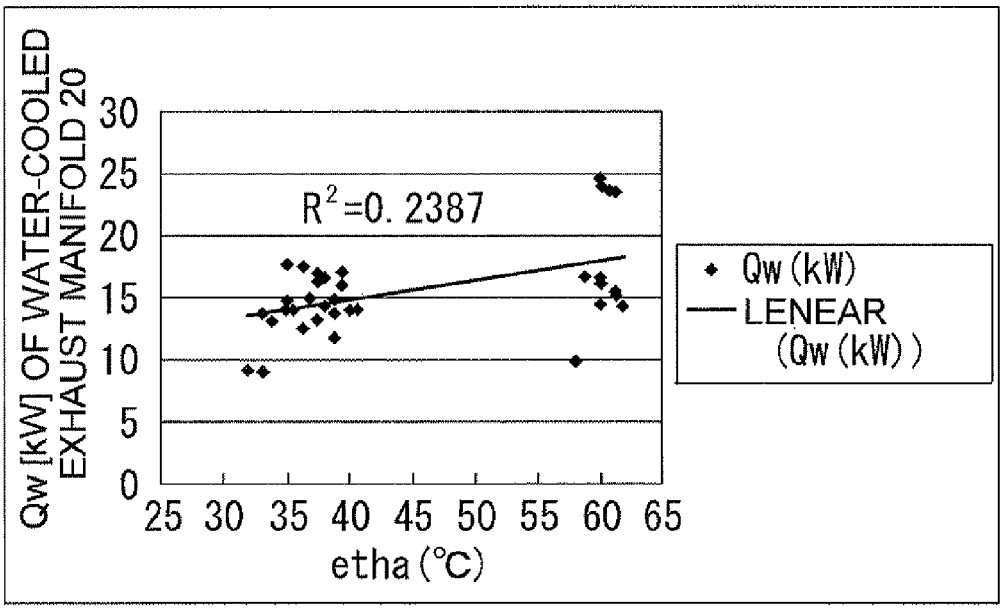
FIG. 8 is a diagram that illustrates a relationship between etha and Qw of the water-cooled exhaust manifold 20.

As illustrated in FIG. 8, in a case where the estimation factor consists of only the intake air temperature etha, which is used as an indicator of the cooling loss Qw, $R^2$ is 0.2387. This case also fails to show that the intake air temperature etha has a strong linear correlation with the cooling loss Qw.

Figure 9:
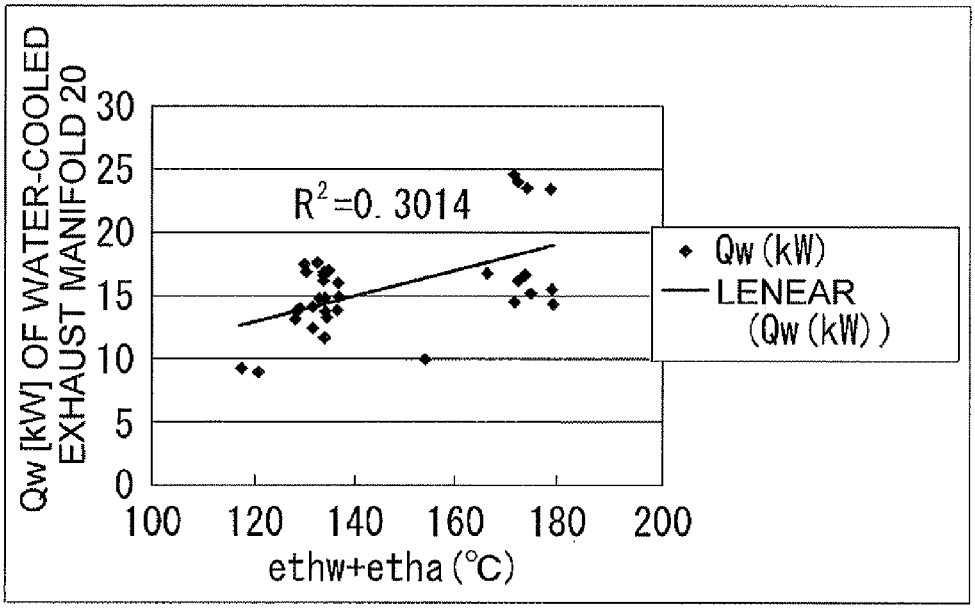
FIG. 9 is a diagram that illustrates a relationship between ethw+etha and Qw of the water-cooled exhaust manifold 20.

Further, as illustrated in FIG. 9, in a case where the estimation factors consist of the cooling water temperature ethw and the intake air temperature etha, and ethw+etha is used as an indicator of the cooling loss Qw, $R^2$ is 0.3014. Therefore, it is not seen that the present indicator has a strong linear correlation with the cooling loss Qw.

Figure 10:
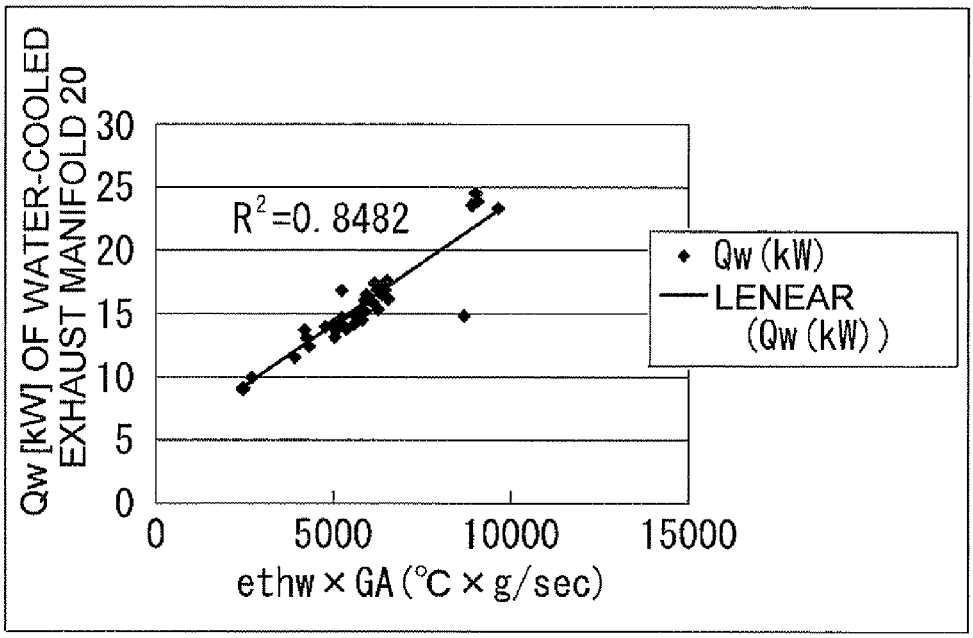
FIG. 10 is a diagram that illustrates a relationship between ethw×GA and Qw of the water-cooled exhaust manifold 20.

In contrast, as illustrated in FIG. 10, in a case where the estimation factors consist of the cooling water temperature ethw and the intake air amount GA, and ethw×GA is used as an indicator of the cooling loss Qw, $R^2$ is 0.8482. It is seen that the present indicator has a strong linear correlation with the cooling loss Qw.

Figure 11:
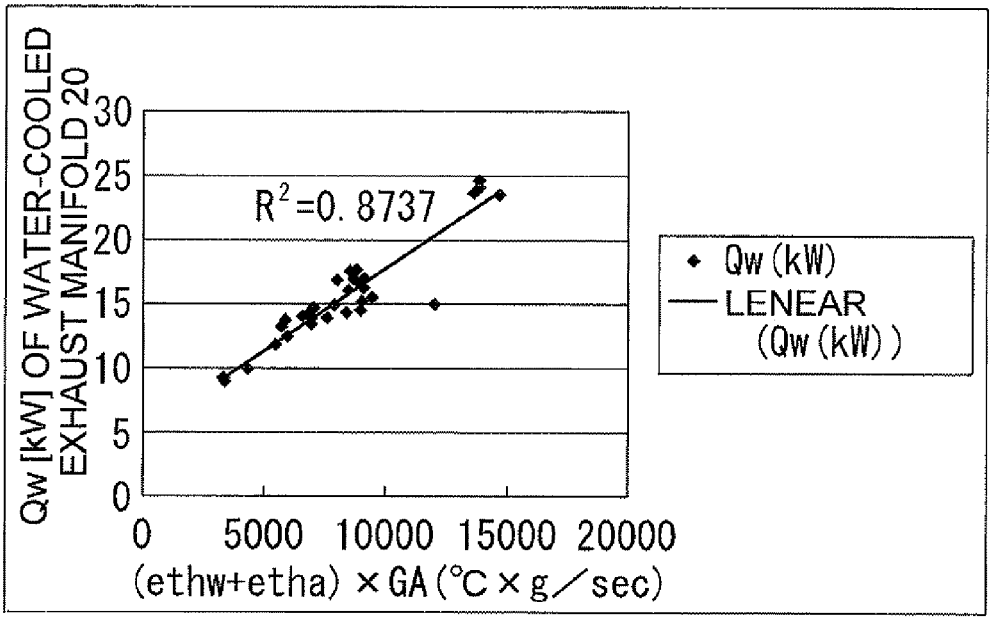
FIG. 11 is a diagram that illustrates (ethw+etha)×GA and Qw of the water-cooled exhaust manifold 20.

As illustrated in FIG. 11, in a case the estimation factors consist of the cooling water temperature ethw, the intake air temperature etha and the intake air amount GA, and (ethw+etha)×GA is used as an indicator of the cooling loss Qw, $R^2$ is 0.8737. This case also show that the present indicator has a strong correlation with the cooling loss Qw.

Thus, the cooling water temperature ethw and the cooling air temperature etha are preferably used as the estimation factors together with the intake air amount GA.

Figure 12:
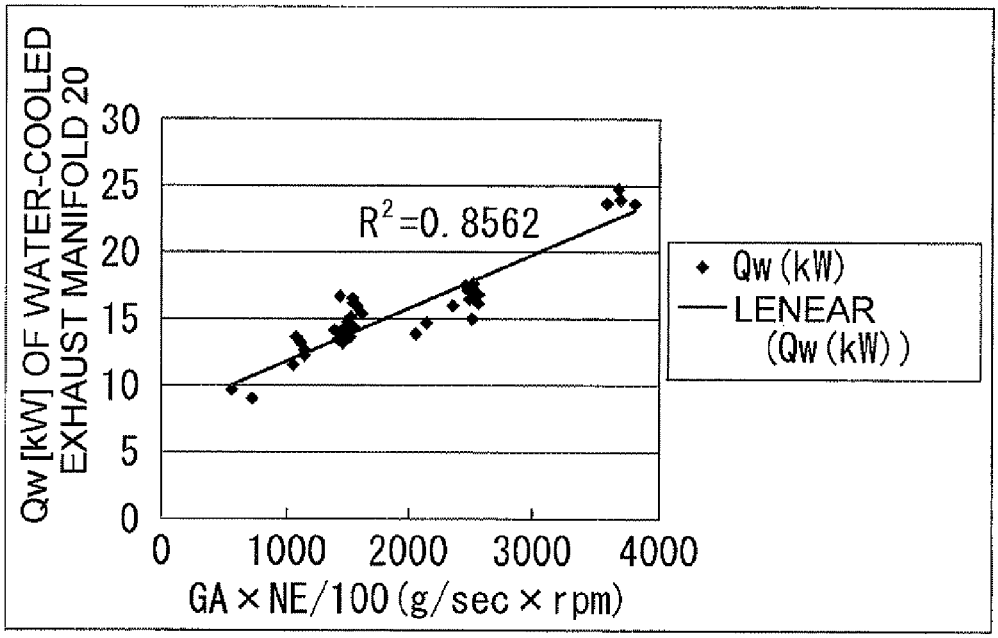
FIG. 12 is a diagram that illustrates GA×NE/100 and Qw of the water-cooled exhaust manifold 20.

The number of revolutions NE represents the magnitude of friction of the internal combustion engine 50. More particularly, as the number of revolutions NE increases, the friction of the internal combustion engine 50 increases. An increase in the friction increases the amount of heat generated in the internal combustion engine 50, and the cooling loss Qw tends to increase. Thus, in cooling the water-cooled exhaust manifold 20 by the cooling water W, it is adequate to additionally consider the number of revolutions NE in order to estimate the cooling loss Qw with higher accuracy. In this regard, as illustrated in FIG. 12, in a case where the estimation factors consist of the intake air amount GA and the number of revolutions NE, and Ga×NE/100 is used as an indicator of the cooling loss Qw, $R^2$ is 0.8562. This case shows that the present indicator has a strong correlation with the cooling loss Qw.

It is seen from FIGS. 6 through 12 that the cooling loss Qw can be estimated with higher accuracy by using the multiple estimation factors including the intake air amount GA (more particularly, at least one of the cooling water temperature ethw, the intake air temperature etha and the number of revolutions NE as well as the intake air amount GA).

Figure 13:
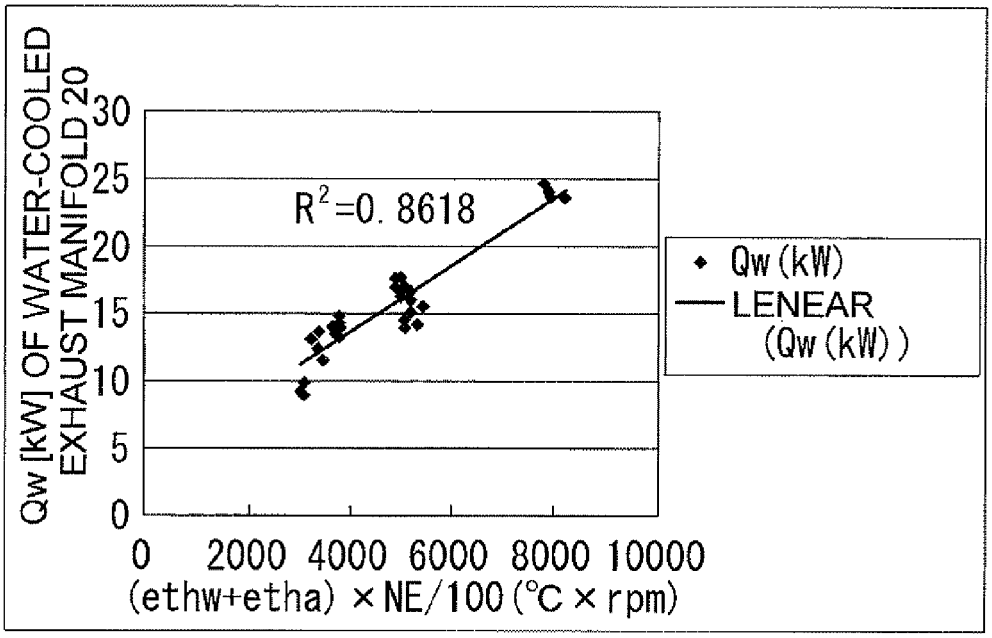
FIG. 13 is a diagram that illustrates (ethw+etha)×NE/100 and Qw of the water-cooled exhaust manifold 20.

As illustrated in FIG. 13, in a case where the estimation factors consist of the cooling water temperature ethw, the intake air temperature etha and the number of revolutions NE, and (ethw+etha)×NE/100 is used as an indicator of the cooling loss Qw, $R^2$ is 0.8618. This case shows that the present indicator has a strong linear correlation with the cooling loss Qw.

Figure 14:
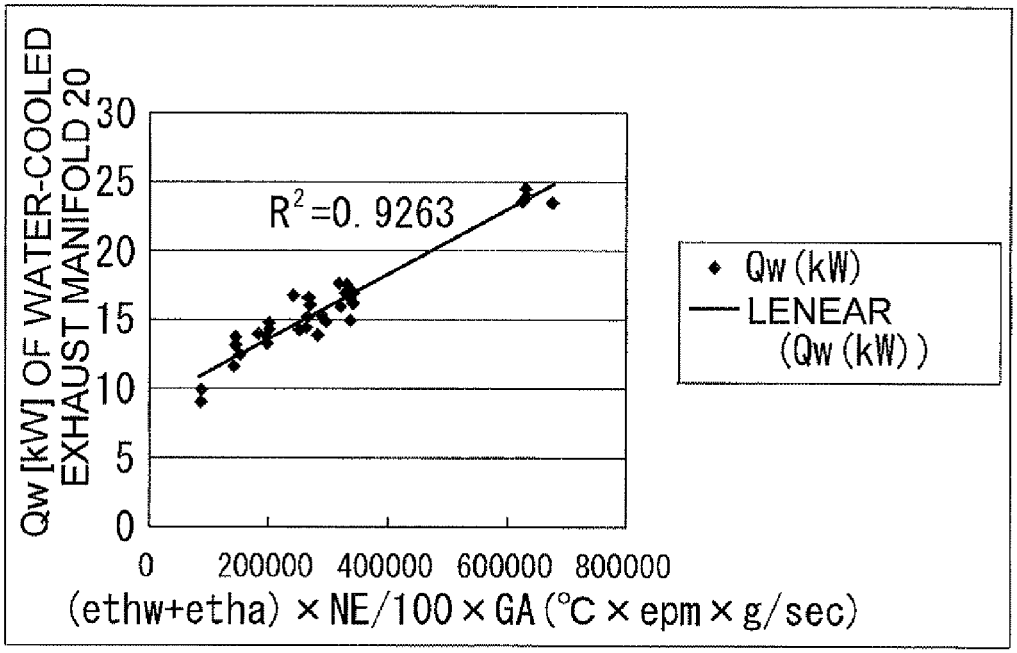
FIG. 14 is a diagram that illustrates (ethw+etha)×NE/100×GA and Qw of the water-cooled exhaust manifold 20.

Further, as illustrated in FIG. 14, in a case where the estimation factors consist of the cooling water temperature ethw, the intake air temperature etha, the number of revolutions NE and the intake air amount GA, and (ethw+etha)×NE/100×GA is used as an indicator of the cooling loss Qw, $R^2$ is 0.9263. That is, in the case where the above four factors are used as the estimation factors, the strongest linear correlation with the cooling loss Qw can be obtained. Thus, it is most preferable to estimate the cooling loss Qw by using the following expression (1) including the four factors:

$$Qw=(ethw+etha)\times NE\times GA \quad (1).$$

That is, it is most preferable that the cooling loss Qw is estimated based on the value calculated by the product of the sum of the cooling water temperature ethw and the intake air temperature etha, the number of revolutions NE and the intake air amount GA. Thus, the ECU 1 estimates the cooling loss Qw on the basis of the expression (1). Generally, the existing sensors may be used to obtain the cooling water temperature ethw, the intake air temperature etha, the number of revolutions NE and the intake air amount GA in order to estimate the cooling loss Qw based on the expression (1) by the ECU 1. It is thus possible to figure out, at low costs, the environmental conditions under which the water-cooled exhaust manifold 20 is used.

Figure 15:
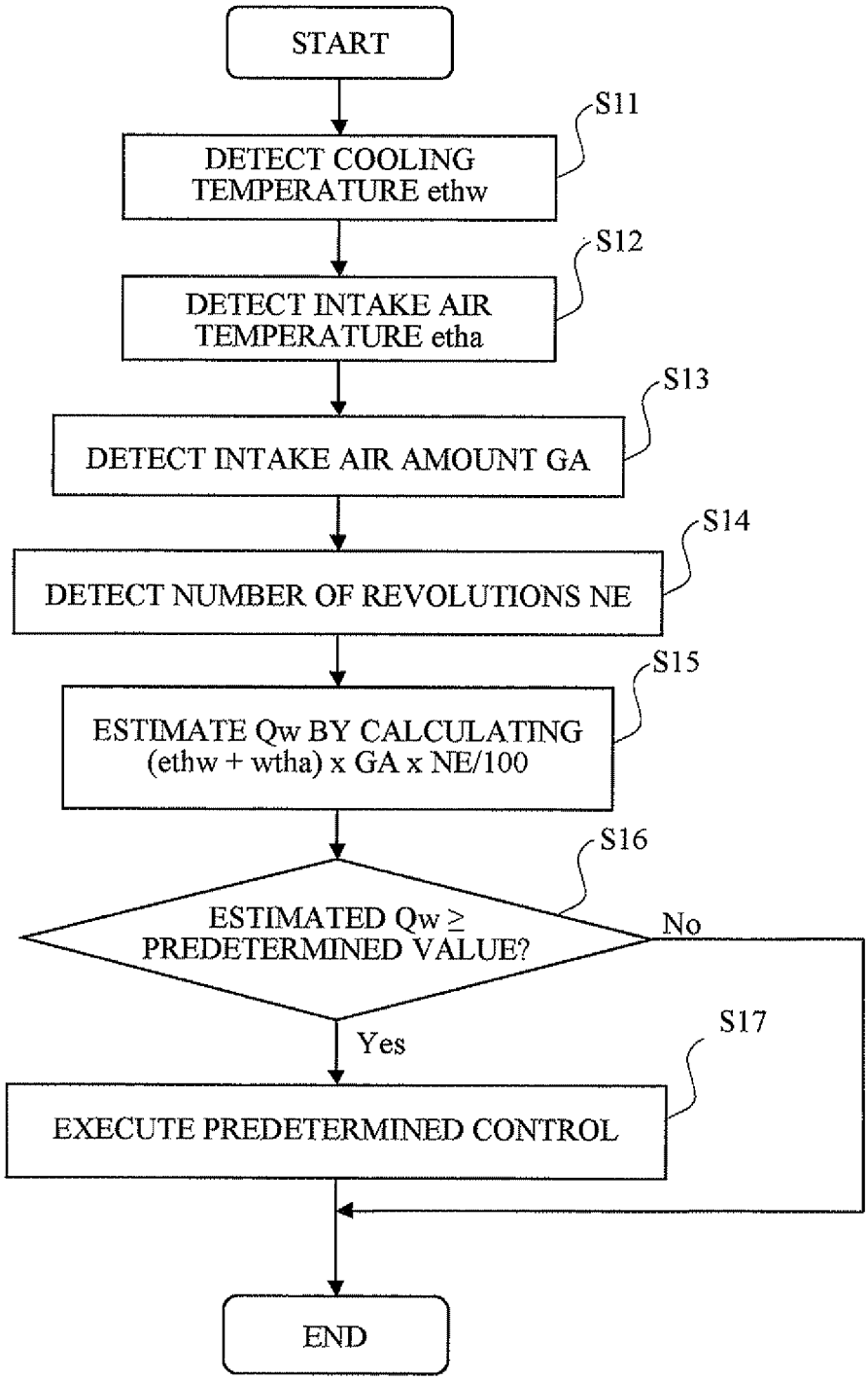
FIG. 15 is a flowchart of a process executed by the ECU 1A.

The process executed by the ECU 1 is described in detail with reference to a flowchart of FIG. 15. The ECU 1 detects the cooling water temperature ethw, the intake cooling temperature etha, the intake air amount GA and the number of revolutions NE (steps S11 through S14). Next, the ECU 1 calculates the current cooling loss Qw using the expression (1) (step S15). Then, the ECU 1 determines whether the estimated cooling loss Qw is equal to or larger than a predetermined value (step S16). For example, the estimated cooling loss Qw may be equal to or larger than the predetermined value when the internal combustion engine 50 operates at an excess air ratio λ of 1 under the heavy-load operating conditions. When the answer of step S16 is NO, the process of the flowchart is ended. In contrast, when the answer of step S16 is YES, the ECU 1 executes a predetermined control (step S17).

The predetermined control may be a control to reduce the amount of heat generated in the internal combustion engine 50, a control to suppress a further increase of the amount of heat in the internal combustion engine 50, or a control to facilitate radiation of heat from the cooling water W.

More particularly, the predetermined control may be a fuel injection control to increase the amount of fuel injected. In this case, it is preferable to vary an increased amount of fuel based on the magnitude of the estimated cooling loss Qw. It is thus possible to reduce the amount of heat generated in the internal combustion engine 50 and prevent the internal combustion engine 50 from overheating.

The predetermined control may be a fuel injection control to decrease the amount of fuel injected and to set the air-fuel ratio higher than the stoichiometric air-fuel ratio. It is thus possible to suppress the fuel consumption and to reduce the amount of heat generated in the internal combustion engine 50 and reduce the exhaust gas temperature. It is therefore possible to prevent the emissions from deteriorating due to overheating of the catalyst and prevent the internal combustion engine 50 from overheating.

The predetermined control may be a control directed to closing the electronic control throttle 12. It is thus possible to reduce the amount of heat generated in the internal combustion engine 50 and reduce the exhaust gas temperature. It is therefore possible to prevent overheating of the internal combustion engine 50 without deteriorating the emissions.

The predetermined control may be a control to inhibit the transmission step of the multistep automatic transmission 60 from being set equal to or less than a predetermined step in response to a kickdown operation. It is thus possible to prevent the number of revolutions NE from increasing greatly and to suppress a further increase in the amount of heat generated in the internal combustion engine 50.

The predetermined control may be a control to set the intake-side VVT 55 and the exhaust-side VVT 56 to a condition under which it is hard to get the intake air in the cylinders. More specifically, for example, the condition under which it is hard to get the intake air in the cylinders may be realized by disabling the intake-side VVT 55 and the exhaust-side VVT 56. It is thus possible to reduce the amount of heat generated in the internal combustion engine 50 and prevent the internal combustion engine 50 from overheating without deteriorating the emissions.

The predetermined control may be a control to retard the valve timing of the exhaust-side VVT 56. It is thus possible to improve the expansion ratio and decrease the exhaust gas temperature. Therefore, the deterioration of the emissions may be suppressed.

The predetermined control may be a control to set the amounts of lift of the VVT 55 and the VVT 56 to a lower-lift side. It is thus possible to reduce the amount of heat generated in the internal combustion engine 50 and prevent the internal combustion engine 50 from overheating.

The predetermined control may be a cylinder cut off control of the internal combustion engine 50. it is thus possible to reduce the amount of heat generated in the internal combustion engine 50 and prevent the internal combustion engine 50 from overheating.

The predetermined control may be a control to increase the number of rotations of the electric fan 32. It is thus possible to facilitate heat radiation of the cooling water W by the radiator 31.

The predetermined control makes it possible to directly or indirectly recover the cooling capability of the cooling water W.

The ECU 1 and the method for estimating the amount of heat received by the refrigerant realized by the ECU 1 are capable of figuring out the environmental conditions under which the water-cooled exhaust manifold 20 is used at low costs by estimating the cooling loss Qw in the water-cooled exhaust manifold 20. The ECU 1 adequately copes with the conditions in which the cooling capability of the cooling water W deteriorates by the control based on the estimated cooling loss Qw.

The above-described embodiments are examples of preferred embodiments of the present invention. However, the present invention is not limited to these embodiments but may be varied or changed variously without departing from the scope of the present invention.

For example, the cooling system of the internal combustion engine 50 including the water-cooled exhaust manifold 20 used in the application of the present invention is not limited to the structure illustrated in FIG. 1, but may have another appropriate structure.

The concrete structure of the water-cooled exhaust manifold 20 used in the application of the present invention is not limited to the structure illustrated in FIG. 2, but may be another appropriate structure in which the whole of the exhaust manifold or a part thereof can be cooled.

The concrete structure of the variable valve train is not limited to the structure illustrated in FIG. 4 but may be another structure capable of varying the valve performance.

The above-described embodiment has an exemplary structure in which the exhaust system cooling means is realized by the water-cooled exhaust manifold 20. However, the exhaust system cooling means may have another appropriate structure capable of cooing the exhaust gas flowing into the catalyst 21 by a refrigerant.

In the above-described embodiment, the cooling water W of the internal combustion engine 50 is used as a refrigerant. However, the refrigerant is not limited to the above but may be cooling water that flows through an exclusively used cooling system provided to the water-cooled exhaust manifold 20. More particularly, the cooling water used in this case may be, for example, LLC (Long Life Coolant) like the cooling water W of the internal combustion engine 50. The use of the cooling water W of the internal combustion engine 50 as a refrigerant is advantageous in terms of cost because there is no need to install the exclusively used cooling system. In the case where the cooling water W of the internal combustion engine 50 is used as a refrigerant, the cooling capability of the cooling water W is likely to deteriorate drastically due to increase in the amount of heat received by the cooling water W. Thus, the present invention is particularly effective to the case where the cooling water W of the internal combustion engine 50 is used as a refrigerant.

It is reasonable to realize the estimating means and the control means used in the application of the present invention by the ECU 1 involved in the control of the internal combustion engine 50. However, these means may be realized by another electronic control device or hardware such as a dedicated electronic circuit or a combination thereof. In this case, the control device of the present invention may be realized by a plurality of electronic control devices, hardware such as electronic circuits, a combination of the electronic control devices and the hardware such as the electronic circuits.

The invention claimed is:

1. A method for controlling an amount of heat generated in an internal combustion engine, the method comprising:

detecting, with a detector, estimation factors including a refrigerant temperature of a refrigerant in an exhaust-system cooling means that cools an exhaust system of an internal combustion engine by the refrigerant, an intake air temperature of the internal combustion engine, a number of revolutions of the internal combustion engine, and an intake air amount of the internal combustion engine;

estimating, with a controller, an amount of heat which the refrigerant receives from an exhaust on the basis of a value obtained by a product of a sum of the refrigerant temperature and the intake air temperature, the number of revolutions and the intake air amount, and controlling, with the controller, based on the estimate of the amount of the heat, the amount of the heat or a radiation of heat from the refrigerant.

2. The method according to claim 1, wherein the refrigerant is a cooling water of the internal combustion engine.

3. A control device comprising:

detecting means for detecting estimation factors including a refrigerant temperature of a refrigerant in an exhaust-system cooling means that cools an exhaust system of an internal combustion engine by the refrigerant, an intake air temperature of the internal combustion engine, a number of revolutions of the internal combustion engine, and an intake air amount of the internal combustion engine;

estimating means for estimating an amount of heat which a refrigerant receives from an exhaust by an exhaust system cooling means that cools an exhaust system of the internal combustion engine by the refrigerant, on the basis of a value obtained by a product of a sum of the refrigerant temperature and the intake air temperature, the number of revolutions and the intake air amount; and control means for performing at least one of a control to reduce an amount of heat generated in the internal combustion engine, a control to increase the amount of heat generated in the internal combustion engine, and a control to facilitate radiation of heat from the refrigerant, when the amount of heat estimated by the estimating means is equal to or larger than a predetermined value.

4. The control device according to claim 3, wherein the control to reduce the amount of heat generated in the internal combustion engine decreases an amount of fuel injected in the internal combustion engine so that an air-fuel ratio is set higher than a stoichiometric air-fuel ratio.

5. The control device according to claim 3, wherein the refrigerant is water of the internal combustion engine.

6. A method for estimating an amount of heat received by a refrigerant comprising:

detecting, with a detector, estimation factors including a refrigerant temperature of a refrigerant in an exhaust-system cooling means that cools an exhaust system of an internal combustion engine by the refrigerant, an intake air temperature of the internal combustion engine, a number of revolutions of the internal combustion engine, and an intake air amount of the internal combustion engine;

estimating, with a controller, the amount of heat which the refrigerant receives from an exhaust by an exhaust system cooling means that cools an exhaust system of the internal combustion engine by the refrigerant, on the basis of a value obtained by a product of a sum of the refrigerant temperature and the intake air temperature, the number of revolutions and the intake air amount; and performing, with the controller, at least one of a control to reduce the amount of heat generated in the internal combustion engine, another control to suppress a further increase in the amount of heat generated in the internal combustion engine, and yet another control to facilitate heat radiation from the refrigerant, when the amount of heat estimated by the estimated means is equal or larger than a predetermined value.

7. The method according to claim 6, wherein the refrigerant is a cooling water of the internal combustion engine.

* * * * *